US009769551B2

(12) United States Patent
Kelly et al.

(10) Patent No.: US 9,769,551 B2
(45) Date of Patent: Sep. 19, 2017

(54) METHOD OF CONNECTING CABLE TO HEADPHONE, AND HEADPHONE FORMED USING SUCH METHODS

(71) Applicant: Skullcandy, Inc., Park City, UT (US)

(72) Inventors: Peter M. Kelly, Park City, UT (US); David G. Vogt, Jr., Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 14/962,849

(22) Filed: Dec. 8, 2015

(65) Prior Publication Data

US 2016/0192049 A1 Jun. 30, 2016

Related U.S. Application Data

(60) Provisional application No. 62/098,977, filed on Dec. 31, 2014.

(51) Int. Cl.
*H04R 25/00* (2006.01)
*H04R 1/06* (2006.01)
*H04R 1/10* (2006.01)

(52) U.S. Cl.
CPC ..... *H04R 1/06* (2013.01); *H04R 1/1033* (2013.01); *H04R 1/1058* (2013.01); *H04R 1/1008* (2013.01)

(58) Field of Classification Search
CPC ..... H04R 1/06; H04R 1/1033; H04R 5/033; H04R 5/0335
USPC ..... 381/384, 394, 395, 371, 374
See application file for complete search history.

(56) References Cited

U.S. PATENT DOCUMENTS

| | | | |
|---|---|---|---|
| 554,716 | A | 2/1896 | McEvoy |
| 1,218,216 | A | 3/1917 | Schmid |
| 1,398,228 | A | 11/1921 | Grisby |
| 1,636,973 | A | 7/1927 | White |
| 1,912,115 | A | 5/1933 | Allen |
| 1,964,350 | A | 6/1934 | Greene |
| 2,325,377 | A | 7/1943 | Dickie |
| 2,366,910 | A | 1/1945 | Kollath |
| 2,386,000 | A | 10/1945 | Dwight |

(Continued)

FOREIGN PATENT DOCUMENTS

| | | |
|---|---|---|
| DE | 3114419 | 10/1982 |
| DE | 3409906 A1 | 9/1985 |

(Continued)

*Primary Examiner* — Davetta W Goins
*Assistant Examiner* — Phylesha Dabney
(74) *Attorney, Agent, or Firm* — TraskBritt

(57) ABSTRACT

A headphone includes an ear-cup housing having an internal surface defining an internal chamber, a hole extending through the ear-cup housing, and a cable anchor device within the ear-cup housing proximate the hole. The cable anchor device includes a first support member attached to the internal surface on a first side of the hole, a second support member attached to the internal surface on a second side of the hole opposite the first side, and a cross member extending between the first support member and the second support member. A method of fabricating a headphone having such a cable anchor device includes inserting a cable through a cable hole extending through the ear-cup housing and wrapping the cable around the cross member of the cable anchor device at least once.

19 Claims, 4 Drawing Sheets

(56) References Cited

U.S. PATENT DOCUMENTS 2,606,224 A 8/1952 Modrey
2,626,299 A 1/1953 Richards
2,800,636 A 7/1957 Schnettler
2,825,039 A 2/1958 Schurman et al.
3,217,282 A 11/1965 Chevalier et al.
3,238,493 A 3/1966 Healy
3,270,312 A 8/1966 Olsen
3,317,884 A 5/1967 Lynch
3,499,097 A 3/1970 Widstrand
3,526,871 A 9/1970 Hobart
3,723,670 A 3/1973 Sebesta et al.
3,744,008 A 7/1973 Castellani
3,786,397 A 1/1974 Bridges
3,946,144 A 3/1976 Quante
3,951,506 A 4/1976 Bennett et al.
4,002,818 A 1/1977 Kunze
4,006,956 A 2/1977 Allgaier
4,023,209 A * 5/1977 Frieder, Jr. ..... A42B 3/166 2/6.2
4,033,535 A 7/1977 Moran
4,089,496 A 5/1978 Mizusawa
4,145,566 A 3/1979 Weingartner
4,157,799 A 6/1979 Simon
4,224,465 A 9/1980 Ruzic
4,346,501 A 8/1982 Saiya
4,350,840 A 9/1982 Michaels
4,460,232 A 7/1984 Sotolongo
4,526,430 A 7/1985 Williams
4,527,855 A 7/1985 Dietrich
4,549,038 A 10/1985 Masheris et al.
4,640,479 A 2/1987 Shely et al.
4,684,192 A 8/1987 Long et al.
4,686,738 A 8/1987 Bladh
4,738,636 A 4/1988 Bolante
4,940,424 A 7/1990 Odbert
5,074,796 A 12/1991 Carter et al.
5,272,525 A 12/1993 Borchardt et al.
5,315,684 A 5/1994 Szegda
5,333,177 A 7/1994 Braitberg et al.
5,354,213 A 10/1994 Hoffman
5,371,821 A 12/1994 Szegda
5,431,578 A 7/1995 Wayne
5,446,788 A * 8/1995 Lucey ..... H04M 1/05 379/430
5,479,479 A 12/1995 Braitberg et al.
5,505,634 A 4/1996 Osten
5,535,274 A 7/1996 Braitberg et al.
5,558,638 A 9/1996 Evers et al.
5,574,819 A 11/1996 Gunther et al.
5,616,046 A 4/1997 Sundstrom et al.
5,640,476 A 6/1997 Womack et al.
5,649,835 A 7/1997 Weed
5,662,488 A 9/1997 Alden
5,692,059 A 11/1997 Kruger
5,773,758 A 6/1998 Coutureau et al.
5,822,427 A 10/1998 Braitberg et al.
5,877,582 A * 3/1999 Nishimura ..... G21K 5/04 313/35
6,069,841 A 5/2000 Johnston
6,080,004 A 6/2000 Kovacik et al.
6,091,453 A 7/2000 Coan et al.
6,106,325 A 8/2000 Kuo
6,135,803 A 10/2000 Kovacik et al.
6,206,714 B1 3/2001 Bernardini
6,257,920 B1 7/2001 Finona et al.
6,274,812 B1 8/2001 Daoud
6,325,339 B1 12/2001 Lewis
6,353,185 B1 3/2002 Sakata
6,463,157 B1 10/2002 May
6,522,765 B1 2/2003 Towle
6,608,254 B1 8/2003 Bernollin et al.
6,672,894 B2 1/2004 Sprunger
6,822,165 B2 11/2004 Nishimoto
6,889,703 B2 5/2005 Bond
6,920,517 B2 7/2005 Mills et al.
6,923,683 B2 8/2005 Dulai et al.
7,032,728 B2 4/2006 Harcourt
7,040,916 B2 5/2006 Schmidt et al.
7,163,408 B1 1/2007 Chen et al.
7,251,409 B2 7/2007 Shakeri
7,331,215 B2 2/2008 Bond
7,391,863 B2 * 6/2008 Viduya ..... H04M 1/05 379/430
7,396,251 B2 7/2008 Kuo
7,477,756 B2 1/2009 Wickstrom et al.
7,579,556 B2 8/2009 Tapper
7,579,557 B2 8/2009 Tapper
7,623,667 B2 11/2009 Sander et al.
7,627,128 B2 12/2009 Sander et al.
7,641,503 B1 1/2010 van der Horn et al.
7,661,567 B2 2/2010 Myers
7,833,055 B2 11/2010 Crooijmans et al.
7,869,608 B2 1/2011 Sander et al.
7,883,375 B2 2/2011 Li et al.
7,884,703 B2 2/2011 Sowada et al.
7,885,419 B2 * 2/2011 Wahl ..... H04M 1/05 381/370
7,901,239 B2 3/2011 Weber
7,955,121 B2 6/2011 Sattazahn et al.
8,004,769 B2 8/2011 Spaller
8,052,468 B2 11/2011 Crooijmans et al.
8,113,869 B2 2/2012 Su et al.
8,194,875 B2 6/2012 Miranda
8,218,799 B2 7/2012 Murphy et al.
8,233,653 B2 7/2012 Giese et al.
8,292,663 B2 10/2012 Crooijmans et al.
8,428,289 B2 4/2013 Wengreen
8,467,560 B2 6/2013 Weber et al.
8,472,660 B2 6/2013 Wengreen
8,554,329 B1 10/2013 Mann et al.
8,556,649 B2 10/2013 Nolting et al.
8,562,890 B2 10/2013 Aase et al.
8,576,569 B2 11/2013 Malek et al.
8,586,879 B2 11/2013 Schadow et al.
8,588,880 B2 11/2013 Abdul-Hafiz et al.
8,600,080 B2 12/2013 Sander et al.
8,613,616 B2 12/2013 Rose et al.
8,655,006 B2 2/2014 Aase et al.
8,722,775 B2 5/2014 Kim et al.
8,821,415 B2 9/2014 Al-Ali et al.
8,870,792 B2 10/2014 Al-Ali et al.
8,891,790 B2 11/2014 Sander et al.
2001/0033664 A1 10/2001 Poux et al.
2002/0020543 A1 2/2002 Krall
2002/0023814 A1 2/2002 Poutiatine
2002/0042222 A1 4/2002 Lin
2002/0148294 A1 10/2002 Bond
2003/0003796 A1 1/2003 Zoiss
2003/0027448 A1 2/2003 Dulai et al.
2004/0032965 A1 * 2/2004 Ito ..... H04R 1/1066 381/381
2004/0039860 A1 2/2004 Mills et al.
2004/0154819 A1 8/2004 Sakata
2004/0254663 A1 12/2004 Dame
2004/0256188 A1 12/2004 Harcourt
2005/0018838 A1 1/2005 Meunier et al.
2005/0172737 A1 8/2005 Bond
2005/0226589 A1 10/2005 Hafner et al.
2006/0013429 A1 * 1/2006 Ohta ..... H04R 1/1033 381/370
2006/0085293 A1 4/2006 Melucci
2006/0166161 A1 7/2006 Rose et al.
2006/0217987 A1 9/2006 Sowada et al.
2006/0227982 A1 10/2006 Miranda
2007/0041605 A1 * 2/2007 Yang ..... H04R 1/1016 381/370
2007/0183616 A1 * 8/2007 Wahl ..... H04M 1/05 381/370
2007/0217642 A1 9/2007 Wickstrom et al.
2007/0238347 A1 10/2007 Kuo
2007/0285906 A1 12/2007 Deverall et al.
2008/0083797 A1 4/2008 Myers
2008/0096156 A1 4/2008 Rose et al.
2008/0137878 A1 6/2008 Killion et al.

(56) References Cited

U.S. PATENT DOCUMENTS

| | | | | |
|---|---|---|---|---|
| 2008/0310666 | A1 | 12/2008 | Wengreen | |
| 2009/0052702 | A1 | 2/2009 | Murphy et al. | |
| 2009/0117777 | A1 | 5/2009 | Chen | |
| 2009/0179768 | A1 | 7/2009 | Sander et al. | |
| 2009/0180353 | A1 | 7/2009 | Sander et al. | |
| 2009/0180354 | A1 | 7/2009 | Sander et al. | |
| 2009/0180629 | A1 | 7/2009 | Sander et al. | |
| 2009/0180630 | A1 | 7/2009 | Sander et al. | |
| 2009/0180642 | A1 | 7/2009 | Sander et al. | |
| 2009/0180643 | A1 | 7/2009 | Sander et al. | |
| 2009/0180659 | A1 | 7/2009 | Sander et al. | |
| 2009/0243965 | A1 | 10/2009 | Price et al. | |
| 2009/0253302 | A1 | 10/2009 | Li et al. | |
| 2009/0289046 | A1 | 11/2009 | Richmond | |
| 2009/0301754 | A1 | 12/2009 | Morley-Smith et al. | |
| 2010/0009575 | A1 | 1/2010 | Crooijmans et al. | |
| 2010/0098277 | A1 | 4/2010 | Giese et al. | |
| 2010/0172519 | A1* | 7/2010 | Kimura | H04R 1/1008 381/151 |
| 2010/0217103 | A1 | 8/2010 | Abdul-Hafiz et al. | |
| 2010/0226017 | A1 | 9/2010 | Spaller | |
| 2010/0256529 | A1 | 10/2010 | Grasing et al. | |
| 2010/0316229 | A1 | 12/2010 | Bibl et al. | |
| 2011/0021084 | A1 | 1/2011 | Crooijmans et al. | |
| 2011/0100708 | A1 | 5/2011 | Lamprecht et al. | |
| 2011/0158455 | A1 | 6/2011 | Kim et al. | |
| 2011/0164778 | A1 | 7/2011 | Wengreen | |
| 2011/0172561 | A1 | 7/2011 | Kiani et al. | |
| 2011/0174926 | A1 | 7/2011 | Margis et al. | |
| 2011/0180321 | A1 | 7/2011 | Aase et al. | |
| 2011/0180962 | A1 | 7/2011 | Aase et al. | |
| 2011/0182460 | A1 | 7/2011 | Aase et al. | |
| 2011/0256779 | A1 | 10/2011 | Aase | |
| 2011/0267690 | A1 | 11/2011 | Spaller | |
| 2012/0015555 | A1 | 1/2012 | Deimel et al. | |
| 2012/0045933 | A1 | 2/2012 | Youtsey | |
| 2012/0076340 | A1* | 3/2012 | Uchida | H04R 5/033 381/370 |
| 2012/0076342 | A1 | 3/2012 | Weber et al. | |
| 2012/0163648 | A1* | 6/2012 | Cardas | H04R 1/1016 381/380 |
| 2012/0176755 | A1 | 7/2012 | Malek et al. | |
| 2012/0178283 | A1 | 7/2012 | Crooijmans et al. | |
| 2012/0231653 | A1 | 9/2012 | Ardisana et al. | |
| 2013/0090567 | A1 | 4/2013 | Lee et al. | |
| 2013/0216740 | A1 | 8/2013 | Russell-Clarke et al. | |
| 2013/0298518 | A1 | 11/2013 | Weber et al. | |
| 2013/0308787 | A1 | 11/2013 | Stanley et al. | |
| 2013/0313097 | A1 | 11/2013 | Yabe et al. | |
| 2013/0318442 | A1 | 11/2013 | Lawson | |
| 2013/0321168 | A1 | 12/2013 | Mahony et al. | |
| 2013/0343592 | A1 | 12/2013 | Schmidt et al. | |
| 2013/0343593 | A1 | 12/2013 | Howes et al. | |
| 2013/0343594 | A1 | 12/2013 | Howes et al. | |
| 2013/0343595 | A1 | 12/2013 | Zorkendorfer et al. | |
| 2014/0058230 | A1 | 2/2014 | Abdul-Hafiz et al. | |
| 2014/0105441 | A1 | 4/2014 | Kroupa | |
| 2014/0110882 | A1 | 4/2014 | Aase et al. | |
| 2014/0159927 | A1 | 6/2014 | Russell-Clarke | |
| 2014/0161298 | A1 | 6/2014 | Russell-Clarke | |
| 2014/0186792 | A1 | 7/2014 | Rose et al. | |
| 2014/0213864 | A1 | 7/2014 | Abdul-Hafiz et al. | |
| 2014/0216811 | A1 | 8/2014 | Turner | |
| 2014/0276776 | A1 | 9/2014 | Parihar et al. | |
| 2014/0283345 | A1 | 9/2014 | Jones | |
| 2014/0288927 | A1 | 9/2014 | Klug | |
| 2014/0371632 | A1 | 12/2014 | Al-Ali et al. | |

FOREIGN PATENT DOCUMENTS

| | | | |
|---|---|---|---|
| DE | 102010031304 | A1 | 1/2001 |
| DE | 20217501 | U1 | 3/2003 |
| DE | 202004005878 | U1 | 10/2005 |
| DE | 102006007604 | A1 | 8/2007 |
| DE | 60129205 | T2 | 6/2008 |
| DE | 202007005126 | U1 | 9/2008 |
| DE | 102007057319 | | 6/2009 |
| EP | 0117092 | A1 | 8/1984 |
| EP | 0465261 | | 7/1991 |
| EP | 0994544 | | 4/2000 |
| EP | 1359643 | | 11/2003 |
| EP | 1903226 | | 3/2008 |
| FR | 899320 | A | 5/1945 |
| GB | 2056191 | | 3/1981 |
| GB | 2171855 | | 9/1986 |
| GB | 2268639 | | 6/1992 |
| JP | 2515703 | Y2 | 10/1986 |
| SU | 1487116 | | 6/1989 |
| WO | 0139334 | | 5/2001 |

* cited by examiner

METHOD OF CONNECTING CABLE TO HEADPHONE, AND HEADPHONE FORMED USING SUCH METHODS

CROSS-REFERENCE TO RELATED APPLICATION

This application claims the benefit of U.S. Provisional Patent Application Ser. No. 62/098,977, filed Dec. 31, 2014, titled "METHOD OF CONNECTING CABLE TO HEADPHONE, AND HEADPHONE FORMED USING SUCH METHODS," the disclosure of which is hereby incorporated herein in its entirety by this reference.

FIELD

Embodiments of the disclosure generally relate to methods of connecting cables to headphones, and to headphones manufactured using such methods.

BACKGROUND

Conventional headphones include one or two speaker assemblies, each having an audio driver that produces audible sound waves using a magnet, coil, and diaphragm. Each speaker assembly may be mounted in an ear-cup housing, and a cushion including foam or another soft material is provided on the side of the ear-cup housing that will abut against the ear and/or head of a person wearing the headphone. The driver may be installed within the ear-cup housing. An electrical cable carrying insulated, electrically conductive wires may extend into the ear-cup housing. The end of the cable external to the ear-cup housing may include an audio jack connector for connection to a media player. As used herein, the term "media player" means and includes any device or system capable of producing an audio signal and wired or wirelessly connectable to a speaker to convert the audio signal to audible sound. For example and without limitation, media players include portable digital music players, portable compact disc players, portable cassette players, mobile phones, smartphones, personal digital assistants (PDAs), radios (e.g., AM, FM, HD, and satellite radios), televisions, eBook readers, portable gaming systems, portable DVD players, laptop computers, tablet computers, desktop computers, stereo systems, and other devices or systems that may be created hereafter. The audio jack connector of the electrical cable may comprise, for example, a tip-sleeve (TS) connector, a tip-ring-sleeve (TRS) connector, a tip-ring-ring-sleeve (TRRS) connector, etc. The wires of the cable at the opposite end of the cable from the audio jack connector may be soldered or otherwise attached to the terminals of the audio driver, such that an electrical sound signal may be transmitted through the cable from the media player to the audio driver during operation and use of the headphone.

During use, audio cables containing the wires and extending from the ear-cup housing are often caught on objects and pulled on, which can result in stresses or strains being transferred to the permanent solder couplings of the wires to the terminal of the audio driver. Continued stresses and strains on the permanent solder couplings can break the couplings and result in a loss of functionality of the headphones.

BRIEF DESCRIPTION OF THE DRAWINGS

The present disclosure may be understood more fully by reference to the following detailed description of example embodiments, which are illustrated in the accompanying figures, in which.

DETAILED DESCRIPTION

The illustrations presented herein are not meant to be actual views of any particular headphone, speaker assembly, ear-cup housing, or component thereof, but are merely simplified schematic representations employed to describe illustrative embodiments of the disclosure. The drawings are not necessarily to scale.

The present disclosure relates generally to headphones having a cable anchor device configured to hinder or prevent accidental detachment of the electrical wires of an audio cable from the driver of a headphone, and to help reduce or eliminate the unintentional application of stress or strain on electrical connections between the electrical wires and the driver during use of the headphone. The cable anchor device may include a cross member around which the audio cable may be wrapped and/or tied. In some embodiments, the cross member is relatively rigid. In other embodiments, the cross member may be relatively flexible so as to absorb at least some tensile strain or stress applied to the cable.

Figure 1:
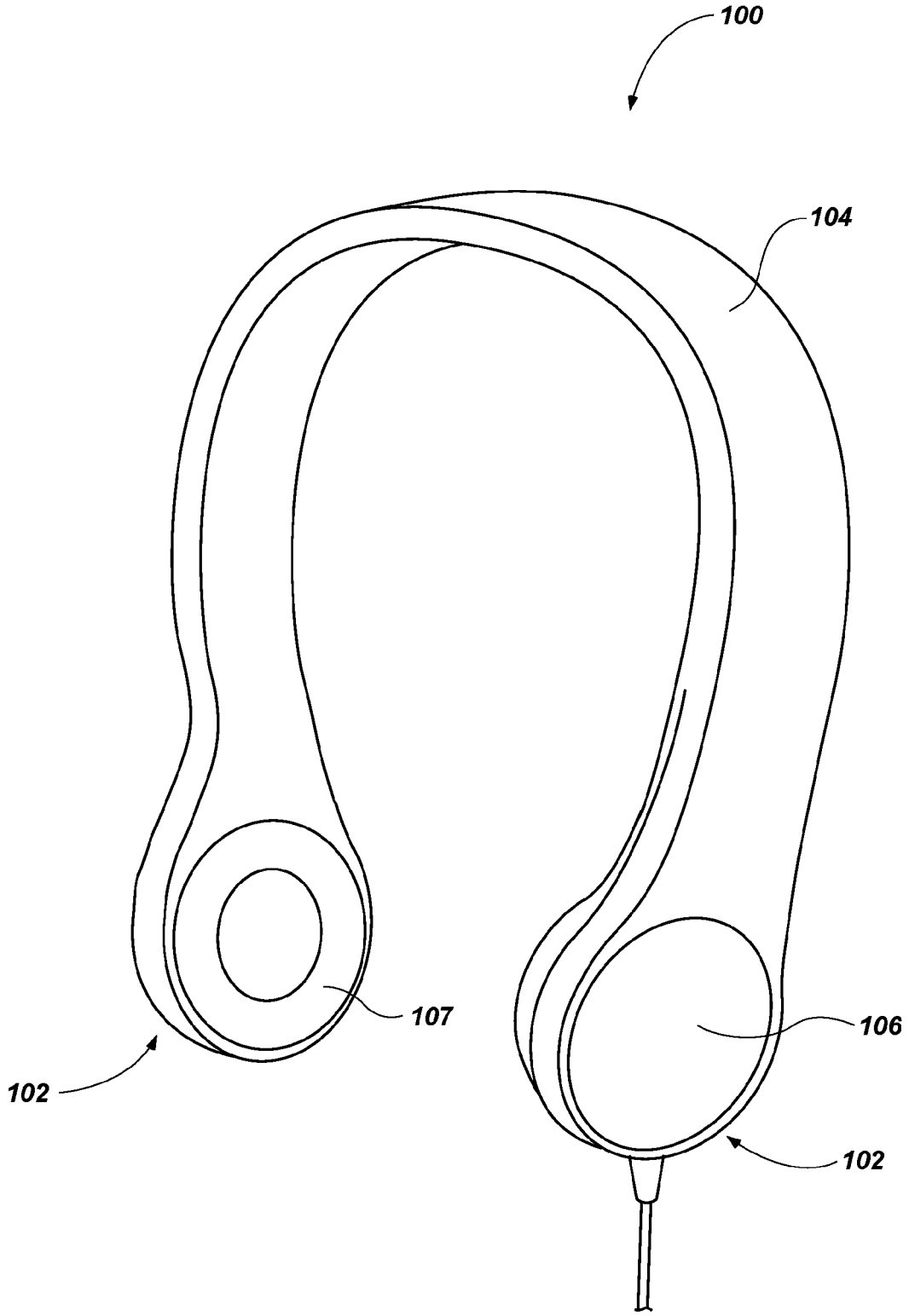
FIG. 1 is a perspective view of an embodiment of a headphone of the present disclosure.

FIG. 1 is a perspective view of a headphone 100 that may include a cable anchor device, as described in further detail below. The headphone 100 of FIG. 1 has two ear-cup assemblies 102 that are connected with a headband 104, which rests on the head of a user and supports the ear-cup assemblies 102 over or on the ears of the user. Each ear-cup assembly 102 includes an outer ear-cup housing 106, and may include a cushion 107 attached to or otherwise carried on the outer ear-cup housing 106. The headphone 100 may be configured to receive an electronic audio signal from a media player through a wired connection (e.g., cable 108 (FIGS. 2A-2C, 3 and 4)) between the headphone 100 and media player (not shown). Each ear-cup assembly 102 may include an electromechanical transducer (which may be referred to in the art as a "driver") configured to convert the electronic audio signal into sound pressure waves audible to a listener. The headphone 100 of FIG. 1 is provided as a non-limiting example of a headphone that may include a cable anchor device as described herein. The headphone 100 is an on-the-ear headphone. The particular configuration of the headphone 100 of FIG. 1 is not important to the present invention, and is provided as a non-limiting example of a headphone. Other types of headphones may also include a cable anchor device as described herein, including over-the-ear headphones and in-the-ear headphones.

Figure 2A:
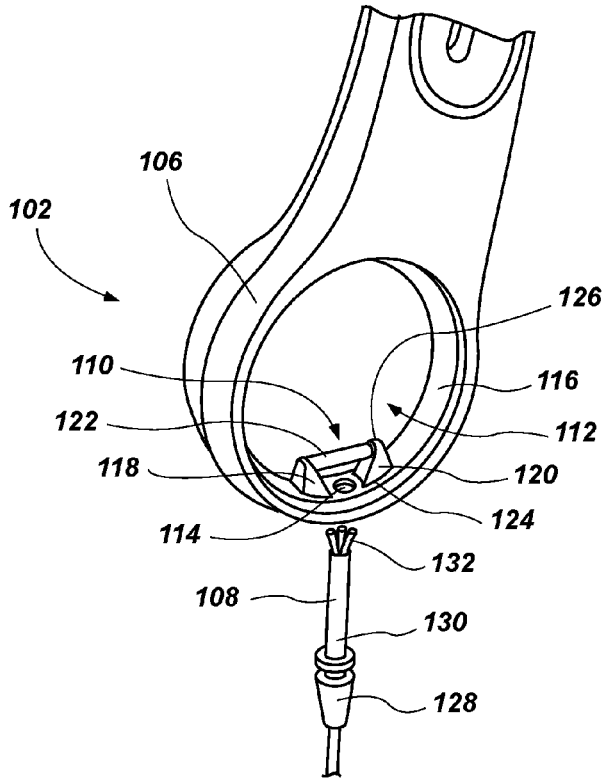
FIGS. 2A-2C are partial perspective views of an ear-cup assembly of the headphone of FIG. 1.
Figure 2B:
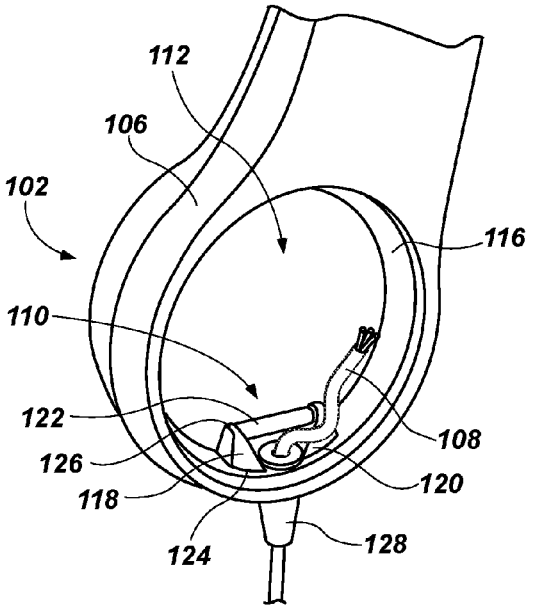
Figure 2C:
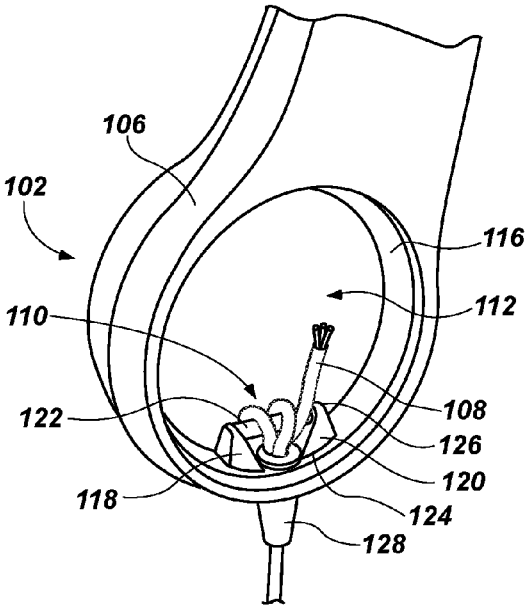

FIGS. 2A-2C are perspective views of an ear-cup assembly 102 of the headphone 100 of FIG. 1 at multiple stages of assembly and manufacture according to an embodiment of the present disclosure. As shown in FIGS. 2A-2C, the ear-cup assembly 102 of the headphone 100 (FIG. 1) may include an internal chamber 112, a cable 108, a strain reliever 128, a cable hole 114, and a cable anchor device 110. The cable anchor device 110 may help to prevent the cable 108 from being accidentally detached from a driver ultimately disposed within the ear-cup assembly 102 and/or from the ear-cup assembly 102. The cable anchor device 110 may further help to prevent damage to electrical connections within the ear-cup assembly 102. As shown in FIGS. 2A-2C, the cable 108 may include the strain reliever 128, and insulating outer sheath 130, and one or more electrically conductive wires 132 disposed within the outer sheath 130.

As shown in FIGS. 2A-2C, the outer ear-cup housing 106 may include an internal surface 116 that defines the internal chamber 112. The cable hole 114 may extend through the outer ear-cup housing 106 from an exterior of the headphone 100 to the internal chamber 112. The cable anchor device 110 may be attached to the internal surface 116 of the internal chamber 112 at a location proximate the cable hole 114. The cable anchor device 110 may include a first support member 118, a second support member 120, and a cross member 122. The first support member 118 of the cable anchor device 110 may be attached to the internal surface 116 of the internal chamber 112 on a first side of the cable hole 114. The second support member 120 of the cable anchor device 110 may be attached to the internal surface 116 of the internal chamber 112 on a second side of the cable hole 114 opposite the first side. Each of the first support member 118 and the second support member 120 may have a base portion 124 attached to the internal surface 116 of the internal chamber 112 and an end portion 126, wherein each support member 118, 120 extends from its base portion 124 to the end portion 126 in a direction toward a central portion of the outer ear-cup housing 106. The first and second support members 118, 120 may have a wider cross section at their respective base portions 124 and may taper as each support member 118, 120 extends toward their end portions 126. In other words, a cross-sectional area of each of the first and second support members 118, 120 may be smaller at the end portions 126 of the first and second support members 118, 120 and may be larger at the base portions 124. In other embodiments, the first and second support members 118, 120 may not taper and may have a substantially consistent cross-sectional area as the first and second support members 118, 120 extend toward their respective end portions 126. In some embodiments, the support members 118, 120 may be made from rigid material (e.g., plastics, metals, etc.). In other embodiments, the support members 118, 120 may be made from flexible material, as discussed in further detail below.

The cross member 122 of the cable anchor device 110 may extend between the first support member 118 and the second support member 120 and may be connected to each of the first support member 118 and the second support member 120 near the end portions 126 of each of the first support member 118 and the second support member 120. In some embodiments, the cross member 122 of the cable anchor device 110 may extend between the first support member 118 and the second support member 120 such that the cross member 122 extends directly over the cable hole 114. In other words, the cross member 122 may be substantially centered over the cable hole 114. In other embodiments, the cross member 112 may be disposed at least slightly to a side of the cable hole 114. In some embodiments, the cross member 112 may have a substantially cylindrical exterior surface. In other embodiments, the cross member 112 may have a rectangular or other geometrically shaped exterior surface.

In some embodiments, the first support member 118, second support member 120, and cross member 112 may all form a single unitary piece and may be formed of the same materials. Additionally, the first support member 118, second support member 120, and cross member 112 may be integral portions of the ear-cup housing 106. In other embodiments, the first support member 118, second support member 120, and cross member 112 may be separate pieces that are assembled together to form the cable anchor device 110. In such embodiments, the first support member 118, second support member 120, and cross member 112 may comprise the same material. In other embodiments, the first support member 118 and second support member 120 may comprise a first material and the cross member 112 may comprise a second material. For example, the first material may be rigid and the second material may be relatively flexible, as discussed in further detail below in regard to FIG. 3. As another non-limiting example, the first and second materials may both be rigid or flexible. In yet other embodiments, the first material may be flexible and the second material may be rigid.

Referring to FIG. 2C, a distance between the cross member 112 and the internal surface 116 of the internal chamber 112 may be sufficient such that the cable 108 may wrap around the cross member 122 one or more times. As shown in FIG. 2C, the cable 108 may extend through the cable hole 114 and may wrap around the cross member 112 at least once, and then may extend to and connect to electronic components within the ear-cup assembly 102. Furthermore, the at least one wire 132 of the cable 108 may be electrically connected (e.g., soldered) to the electronic components such as a driver. Wrapping the cable 108 around the cross member 112 may prevent any stresses or strains experienced by the cable 108 from being transferred to the electronic connections (e.g., soldered connections between the at least one wire 132 of the cable 108 and a driver). In some embodiments, the cable 108 may be tied around the cross member 112 (e.g., tied in a knot such that the cross member 112 extends through the knot) to as to prevent the cable 108 from unraveling or slipping around the cross member 122 when a tensile force is applied to the cable 108.

Headphones are often used in activities that may result in cables connected to the headphones being pulled on or tugged on during use, which often places tensile stress or strain on the electrical connection within the ear-cup assembly. For example, headphones are commonly used during physical exercise during which the cables of the headphone may be caught on objects such that tensile stress or stain is transferred to the electrical connections.

In contrast to previously known headphones, wherein a common point of failure was the electrical connections (e.g., soldered connections) between the at least one wire 132 of the cable 108 and electronic components within the ear-cup assembly 102 due to tensile stresses and strains placed on the electrical connections due to normal use of the headphones by a user (e.g., cable 108 getting caught on something during use and tugging at the headphone), wrapping the cable 108 around the cross member 122 of the cable anchor device 110 may transfer tensile stress or strain applied to the cable 108 to the cable anchor device 110 instead of to the electrical connections between the wires 132 within the cable 108 and the audio driver.

The cable 108 may be at least substantially prevented from moving within the ear-cup assembly 102 due to frictional forces between the insulating outer sheath 130 of the cable 108 and the cross-member 122 of the cable anchor device 110. Thus, when the cable 108 is subject to tensile stress and strain, the portion of the cable 108 wrapped around the cross member 122 of the cable anchor device 110 may be substantially prevented from moving or slipping around the cross member 122, which in turn, prevents application of tensile force to the electrical connections between the wires 132 and the driver. Thus, wrapping the cable 108 around the cross member 122 of the cable anchor device 110 (e.g., tying the cable 108 in a knot around the cross member 122) may prevent tensile stress or strain experienced by the cable 108 outside of the ear-cup assembly 102 from being transferred to the electrical connections between the wires 132 and the driver.

Figure 3:
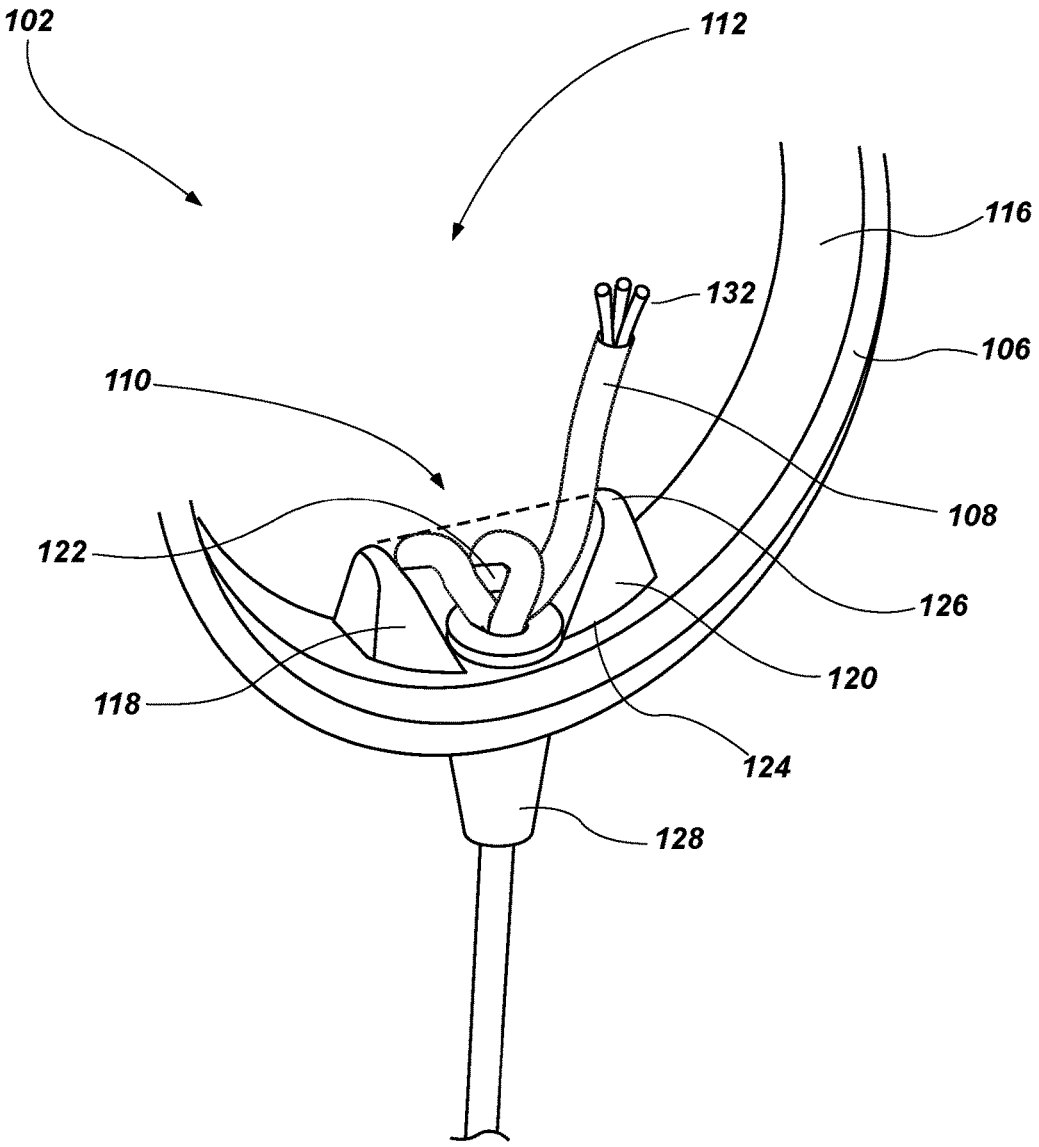
FIG. 3 is a partial perspective view of an ear-cup of a headphone according to another embodiment of the present disclosure.
Figure 4:
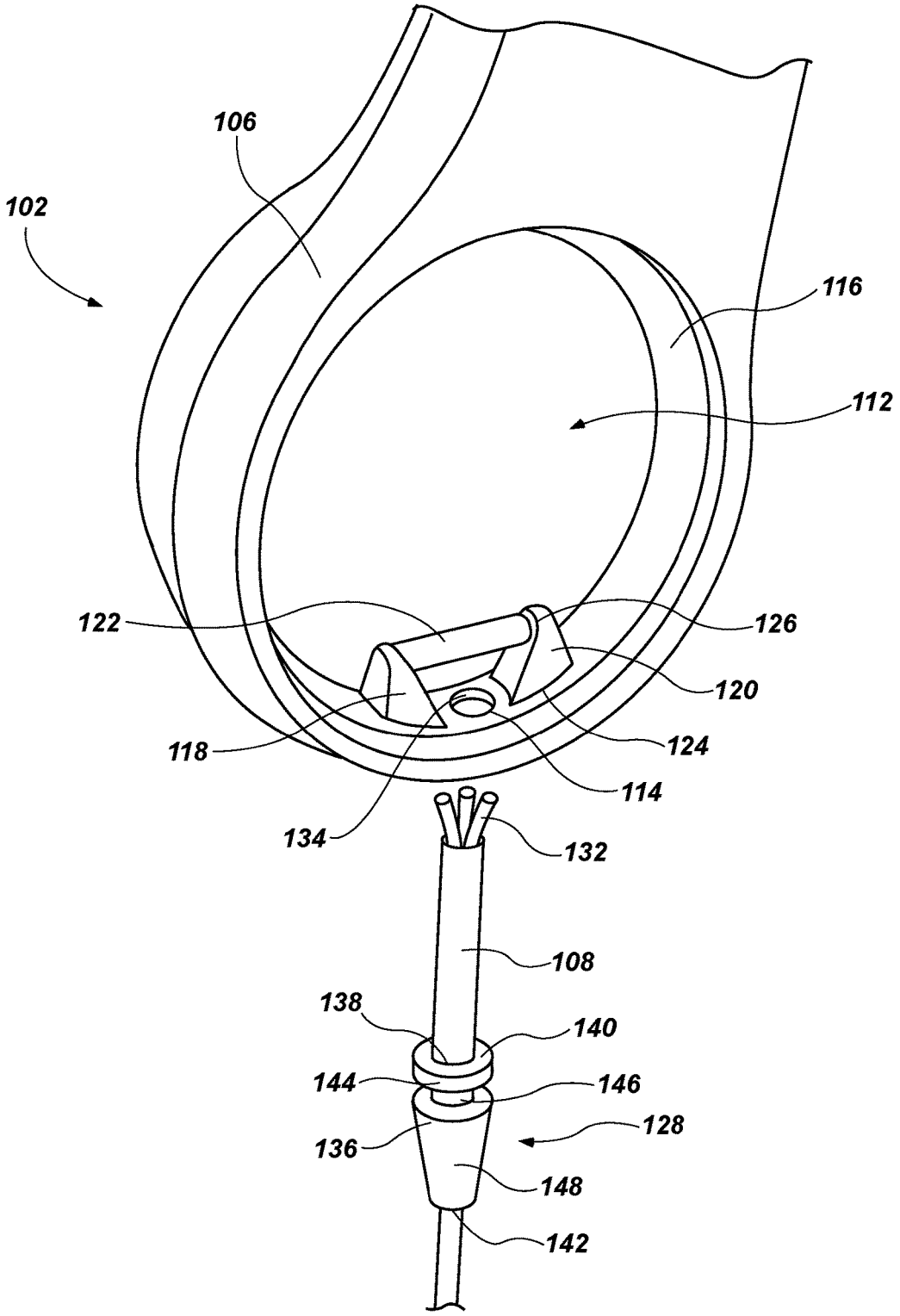
FIG. 4 is an enlarged perspective view of the ear-cup assembly of the headphone depicted in FIG. 2A.

In some embodiments, the cross member 112 and first and second support members 118, 120 may be made of a rigid material, such that when the cable 108 of the headphone 100 (FIG. 1) experiences tensile stress or strain, the cross member 112 and first and second support members 118, 120 do not deform (i.e., flex, stretch, or bend) in any significant manner. In other embodiments, as shown in FIG. 3, the cross member 122 may be made of a flexible material, such that when the cable 108 of the headphone 100 (FIG. 1) experiences tensile stress or strain, the cross member 112 may at least partially deform (i.e., bend, flex, or stretch) to absorb some of the stress or strain applied to the cable 108. In such embodiments, the cross member 122 may be made of an elastomeric material such as natural rubber (e.g., latex) or synthetic rubber (e.g., silicone). In other embodiments, the cross member 122 may be made of a rigid material and the first and second support members 118, 120 may be made of a flexible material, such that when the cable 108 of the headphone 100 is pulled on, the cross member 112 may not deform but may at least partially compress the first and second support members 118, 120 to absorb some of the stress or strain applied to the cable 108. FIG. 4 illustrates such a flexible cross member 112 in a deformed state caused by application of tensile force to the cable 108.

As illustrated in FIG. 4, the headphone 100 (FIG. 1) may include a strain reliever 128 disposed around the cable 108 at the junction between the cable 108 and the ear-cup housing 106. The strain reliever 128 may reduce strain placed on the cable 108 during normal use by a user by at least partially preventing the cable 108 from bending at an extreme angle, kinking, or directly pressing against an edge 134 of the cable hole 114 that extends through the ear-cup housing 106.

In some embodiments, the strain reliever 128 may be bonded to the insulating outer sheath 130 of the cable 108. In other embodiments, the strain reliever 128 may be a sleeve that is not bonded to the insulating outer sheath 130, but which is simply disposed over, but not bonded to, the cable 108. The strain reliever 128 may include one or more features that interlock with the ear-cup housing 106 at the cable hole 114 so as to prevent relative movement between the strain reliever 128 and the ear-cup housing 106.

The strain reliever 128 may comprise a tubular elastomeric body 136. The tubular elastomeric body 136 may be made of any flexible material such as natural rubber (e.g., latex) or synthetic rubber (e.g., silicone). The tubular elastomeric body 136 may include a first end 140, a second end 142 opposite the first end 140, a flange 144, a recessed portion 146, a tapered portion 148, and a central bore 138. The central bore 138 may extend axially along a center axis of the tubular elastomeric body 136, wherein the central bore 138 extends from the first end 140 to the second end 142 of the tubular elastomeric body 136. The central bore 138 may be sized and shaped to fit the insulating outer sheath 130 of the cable 108 such that the cable 108 may extend therethrough. In some embodiments, the first end 140 of the tubular elastomeric body 136 may be substantially planar and may form one side of the flange 144. In other embodiments, the first end 140 of the tubular elastomeric body 136 may have a substantially convex, concave, or partially curved shape and may form one side of the flange 144. The recessed portion 146 may be proximate the first end 140 of the tubular elastomeric body 136 and may form another side of the flange 144. The second end 142 may also be substantially planar. In other embodiments, the second end 142 of the tubular elastomeric body 136 may have a substantially convex, concave, or partially curved shape.

The tapered portion 148 of the tubular elastomeric body 136 may begin at the recessed portion 146 and may extend to the second end 142 of the tubular elastomeric body 136. The tapered portion 148 may have a larger diameter near the recessed portion 146 and a smaller diameter near the second end 142. The recessed portion 146 of the tubular elastomeric body 136 may have a diameter substantially equal to a diameter of the cable hole 114 of the ear-cup assembly 102 such that the strain reliever 128 may be inserted into the cable hole 114. When the strain reliever 128 is inserted into the cable hole 114 of the ear-cup assembly 102, the flange 144 may be disposed within the internal chamber 112 of outer ear-cup housing 106, and the another side of the flange 144 may abut up against the internal surface 116 of the internal chamber 112. The flange 144 may at least partially hinder detachment of the strain reliever 128 from the outer ear-cup housing 106.

The strain reliever 128 may assist in preventing damage to the cable 108 and internal components of the ear-cup assembly 102. For example, the strain reliever 128 may keep the cable 108 at least substantially centered within the cable hole 114 such that when the cable 108 is subjected to stresses or strains, any resulting forces may be generally perpendicular to the cross member 122 of the cable anchor device 110. Furthermore, as mentioned previously, the strain reliever 128 may assist in preventing the cable 108 from bending at extreme angles, which can cause damage to the wires 132 within the cable 108.

Additionally, in conjunction with the cable anchor device 110, the strain reliever 128 may assist in preventing the cable 108 from being accidentally detached from the ear-cup assembly 102 due to tensile stress or strain applied to the cable 108. For example, when the strain reliever 128 is bonded to the cable 108 or when frictional forces between the strain reliever 128 and the cable 108 at least partially hinders movement of the strain reliever 128 relative to the cable 108, the flange 144 may prevent any stresses or strains applied to the cable 108 from being transferred to electrical connections between the wires 138 and the driver, and may absorb such stresses or strains. Moreover, when the strain reliever 128 is bonded to the cable 108 or when frictional forces between the strain reliever 128 and the cable 108 at least partially hinders movement of the strain reliever 128 relative to the cable 108, the strain reliever 128 may reduce the magnitude of any stresses or strains transferred to the cable anchor device 110. For example, given some slack in the cable 108 between a part of the cable 108 extending from the first end 140 of the tubular elastomeric body 136 and a part of the cable 108 beginning to wrap around the cross member 122, when the cable 108 experiences a stress or strain, the tubular elastomeric body 136 may stretch or flex and absorb the stress or strain while the flange 144 prevents the stress reliever 128 from being pulled from the outer ear-cup housing 106. Furthermore, even if the flange 144 of the strain reliever 128 is temporarily and partially pulled into the cable hole 114, any slack in the cable 108 may allow the stress reliever 128 to absorb the stresses or strains applied to the cable 108 without transferring the stresses or strains to the cable anchor device 110.

Thus, the strain reliever 128 and cable anchor device 110 may work in conjunction to prevent stress or strain applied to the cable 108 from being transferred to the electrical connections between the wires 132 and the driver. For example, the strain reliever 128 may prevent smaller stresses or strains from being transferred to the cable anchor device 110. Furthermore, when the strain reliever 128 is incapable of absorbing the entire magnitude of stresses and strains applied to the cable 108, the cable anchor device 110 may further absorb the stresses or strains and prevent the application of stress or strain to the couplings between the wires 132 and the terminals of the driver.

In some embodiments, each ear-cup assembly 102 of the headphone 100 may have a respective cable 108 extending therefrom, and in such embodiments, each ear-cup assembly 102 may include a respective cable anchor device 110 and strain reliever 128. In other embodiments, only one of the ear-cup assemblies 102 may have a cable 108 extending therefrom. In such embodiments, only the ear-cup assembly 102 having a cable 108 may include a cable anchor device 110 and strain reliever 128.

In some embodiments, the cable 108 may not include any reinforcing wires or fibers that are not used for conducting an electrical audio signal within the insulating outer sheath 130. In other embodiments, however, the cable 108 may include such reinforcing wires or fibers for increasing a tensile strength of the cable 108.

The embodiments of the invention described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosed embodiments, such as alternative useful combinations of the described elements of the embodiments, will become apparent to those skilled in the art from the description. Such modifications are also intended to fall within the scope of the appended claims.

What is claimed is:

1. A headphone, comprising:
- an ear-cup housing having an internal surface defining an internal chamber;
- a hole extending through the ear-cup housing; and
- a cable anchor device within the ear-cup housing proximate the hole, the cable anchor device comprising:
  - a first support member attached to the internal surface on a first side of the hole;
  - a second support member attached to the internal surface on a second side of the hole opposite the first side; and
  - a cross member extending between the first support member and the second support member; and
- a cable extending through the hole of the ear-cup housing and wrapped at least once around the cross member of the cable anchor device.

2. The headphone of claim 1, wherein the cable is tied in a knot around the cross member of the cable anchor device.

3. The headphone of claim 1, further comprising:
- a strain reliever comprising a tubular body extending through the hole and having a central bore extending axially through the tubular body, the cable extending through the central bore of the strain reliever.

4. The headphone of claim 3, wherein the strain reliever further comprises a flange disposed on an end of the tubular body, wherein the flange is configured to abut against the internal surface of the internal chamber of the ear-cup housing when the strain reliever is attached to the ear-cup housing.

5. The headphone of claim 1, wherein the cross member comprises a flexible material.

6. The headphone of claim 1, wherein the cross member comprises a rigid material.

7. The headphone of claim 1, wherein the cross member extends directly over the hole within the ear-cup housing.

8. The headphone of claim 1, wherein the cross member is disposed laterally beside the hole within the ear-cup housing.

9. A headphone, comprising:
- an ear-cup housing having an internal surface defining an internal chamber;
- a hole extending through the ear-cup housing;
- a cross member coupled with the ear-cup housing proximate the hole; and
- a cable extending through the hole of the ear-cup housing and wrapped at least once around the cross member.

10. The headphone of claim 9, further comprising a strain reliever surrounding the cable and disposed between the cable and an edge of the hole.

11. The headphone of claim 10, wherein the strain reliever further comprises an elastomeric body having a flange disposed within the internal chamber of the ear-cup housing and a tapered portion disposed on an exterior of the ear-cup housing.

12. The headphone of claim 9, wherein the cross member comprises a flexible material.

13. The headphone of claim 9, wherein the cross member comprises a rigid material.

14. The headphone of claim 9, wherein the cross member is disposed directly over the hole.

15. The headphone of claim 9, wherein the cross member is disposed laterally beside the hole.

16. The headphone of claim 9, wherein the cross member comprises an integral portion of the ear-cup housing.

17. A method of fabricating a headphone, comprising:
- providing an ear cup assembly, including:
  - an outer ear-cup housing;
  - a cable hole extending through the outer ear-cup housing; and
  - a cable anchor device, comprising:
    - a first support member disposed within the outer ear-cup housing proximate a first side of the cable hole;
    - a second support member disposed within the outer ear-cup housing proximate a second side of the cable hole; and
    - a cross member extending between the first support member and second support member;
- inserting a cable through the cable hole; and
- wrapping the cable around the cross member at least once.

18. The method of claim 17, further comprising:
- providing a strain reliever surrounding a portion of the cable, wherein inserting the cable through the cable hole comprises inserting a flange attached to an end of the strain reliever through the cable hole.

19. The method of claim 17, wherein wrapping the cable around the cross member at least once comprises tying the cable in a knot around the cross member.

* * * * *